US011713656B2

(12) United States Patent
Ben-Zvi et al.

(10) Patent No.: US 11,713,656 B2
(45) Date of Patent: Aug. 1, 2023

(54) NON-CONDENSABLE GAS MANAGEMENT DURING PRODUCTION OF IN-SITU HYDROCARBONS

(71) Applicant: Cenovus Energy Inc., Calgary (CA)

(72) Inventors: Amos Ben-Zvi, Calgary (CA); Amin Fardi, Calgary (CA); Simon D Gittins, Calgary (CA); Michael Miller, Calgary (CA); Ryan Miller, Calgary (CA); Trenton M Schrader, Calgary (CA)

(73) Assignee: Cenovus Energy Inc., Calgary (CA)

( * ) Notice: Subject to any disclaimer, the term of this patent is extended or adjusted under 35 U.S.C. 154(b) by 41 days.

(21) Appl. No.: 17/352,152

(22) Filed: Jun. 18, 2021

(65) Prior Publication Data

US 2021/0396106 A1 Dec. 23, 2021

Related U.S. Application Data

(60) Provisional application No. 63/040,930, filed on Jun. 18, 2020.

(51) Int. Cl.

| | |
|---|---|
| ***E21B 43/12*** | (2006.01) |
| ***E21B 47/06*** | (2012.01) |
| ***E21B 43/16*** | (2006.01) |

(52) U.S. Cl.

CPC ..... *E21B 43/12* (2013.01); *E21B 43/168* (2013.01); *E21B 47/06* (2013.01)

(58) Field of Classification Search

CPC ..... E21B 43/12; E21B 43/16; E21B 43/168; E21B 47/06

See application file for complete search history.

(56) References Cited

U.S. PATENT DOCUMENTS 5,626,193 A * 5/1997 Nzekwu ..... E21B 43/2406 166/50
2012/0312534 A1* 12/2012 Nasr ..... E21B 43/168 166/272.3

(Continued)

FOREIGN PATENT DOCUMENTS

CA 2698898 A1 7/2011
CA 2757125 A1 2/2013

(Continued)

*Primary Examiner* — Theodore N Yao

(74) *Attorney, Agent, or Firm* — Gordon & Jacobson, P.C.

(57) ABSTRACT

Methods for producing hydrocarbons from subterranean reservoirs utilize a production well having a plurality of individually-actuatable fluid-inlet components that are spaced apart to define a plurality of production-well fluid-inlet zones. An injection fluid including a non-condensable gas (NCG) is injected into the reservoir, such that a drainage fluid including at least a portion of the NCG occupies the production-well fluid-inlet zones. The gas phase:liquid phase ratio of a production fluid is modulated by identifying at least one of the production-well fluid-inlet zones as having a gas content above a threshold and thus being a higher-gas zone, and actuating variations in pump speed and the flow states of the plurality of fluid-inlet components adjacent and corresponding to the higher-gas zone to prioritize hydraulic communication with a subset of the plurality of production-well fluid-inlet zones spaced apart from the higher-gas zone.

23 Claims, 10 Drawing Sheets

(56) References Cited

U.S. PATENT DOCUMENTS

| | | | | |
|---|---|---|---|---|
| 2014/0216733 | A1* | 8/2014 | Mathiesen | E21B 43/32<br>166/252.5 |
| 2015/0285051 | A1* | 10/2015 | Miller | E21B 43/2408<br>166/272.3 |
| 2018/0306693 | A1* | 10/2018 | Nazari | E21B 47/06 |
| 2019/0120043 | A1* | 4/2019 | Gupta | E21B 47/047 |

FOREIGN PATENT DOCUMENTS

| | | | |
|---|---|---|---|
| CA | 2831928 | A1 | 5/2014 |
| CA | 2886934 | A1 | 9/2015 |

* cited by examiner

NON-CONDENSABLE GAS MANAGEMENT DURING PRODUCTION OF IN-SITU HYDROCARBONS

TECHNICAL FIELD

The present disclosure generally relates to methods for in-situ hydrocarbon production. In particular, the present disclosure relates to hydrocarbon-production processes that involve injecting non-condensable gas, for example to maintain reservoir pressure during ramp-down and/or blowdown.

BACKGROUND

Viscous hydrocarbons can be extracted from some subterranean reservoirs using in-situ production processes. Some in-situ production processes are thermal processes wherein heat energy is introduced to a reservoir to lower the viscosity of hydrocarbons in situ such that they can be recovered from a production well. In some thermal processes, heat energy is introduced by injecting a heated injection fluid into the reservoir by way of an injection well. Steam-assisted gravity drainage (SAGD) is a representative thermal-recovery process that uses steam to mobilize hydrocarbons in situ.

Some thermal recovery processes employ injection fluids that include solvent, optionally in combination with steam. Solvent-aided processes (SAP) are one such category. In the context of the present disclosure, SAP injection fluids comprise less than about 50% solvent and greater than about 50% steam on a mass basis. Solvent-driven processes (SDP) are another such category. In the context of the present disclosure, SDP injection fluids comprise greater than about 50% solvent and less than about 50% steam on a mass basis. SAGD, SAP and/or SDP processes are typically employed as parts of a broader production profile. For example, a well may be transitioned through a life cycle that includes: (i) a start-up phase during which hydraulic communication is established between an injection well and a production well; (ii) a SAGD phase during which a production chamber expands primarily in a vertical direction from the injection well and mobilized hydrocarbons are recovered from the production well along with condensed steam; (iii) an SAP and/or SDP phase during which injected solvent facilitates further chamber growth and hydrocarbon mobilization such that solvent and mobilized hydrocarbons are produced via the production well; and (iv) a ramp-down and/or blowdown phase during which non-condensable gas (NCG) is injected alone or in combination with steam to recover residual hydrocarbons and solvent that would otherwise remain stranded. In some cases, a well may be transitioned from a start-up phase to a SAP and/or SDP phase without an intervening SAGD phase.

Heavy oil reservoirs are often developed as a series of "regions" or "areas", such that adjacent wells are often at different phases of this life cycle. Due to the inherent thermal connectivity of adjacent areas of a reservoir under development, there is a risk that as steam/thermal energy injection is reduced in an older (more exploited) area, that area's pressure will decline, creating a flow potential for steam/fluids from adjacent areas under active exploitation. This has the undesirable consequence of accordingly needing to increase injection of fluids and/or thermal energy in the area being actively exploited above what otherwise would be needed for its specific exploitation. Accordingly, an additional motivation for ramp-down and/or blowdown protocols is to maintain pressure to avoid forming an unproductive pressure sink.

Hence, regardless of whether a hydrocarbon production process employs SAGD, SAP, and/or SDP phases, successfully executing the ramp-down and/or blowdown phase is difficult due at least in part to the need to maintain reservoir pressures and continue recovering production fluids even as large volumes of NCG are injected into the reservoir such that the potential for unwanted gas incursion increases significantly. Conventional production-well completions are not well suited to managing high gas-content fluids, and processes that use conventional production-well completions are often plagued by a lack of control over gas phase:liquid phase ratios.

SUMMARY

Accordingly, during most ramp-down and/or blowdown phases, retaining non-condensable gas (NCG) within the reservoir during production is desirable, and there is a need for alternative ramp-down and/or blowdown strategies that allow for a greater degree of control over the extent to which NCGs are produced during late-life well operation.

As set out in detail in the present disclosure, extensive field trials and state-of-the-art simulations indicate that, during ramp-down and/or blowdown, NCG production can be modulated to maintain reservoir pressure and provide improved recovery metrics by taking a coordinated approach to configuring and/or operating two production-well completions, the fluid-inlet components and the pump.

The present disclosure asserts that the pool of drainage fluids surrounding the production well can be segmented into semi-localized in-flow zones by spacing the fluid-inlet components at sufficient distances along the horizontal section of the production well. By employing fluid-inlet components that limit flow of high gas-content drainage fluids, the semi-localized zones that are occupied by high gas-content drainage fluids can be deprioritized in favour of those semi-localized zones occupied by low gas-content drainage fluids. As such, the produced fluids—those permitted within the production well—are better suited to the pump and facility thresholds, and the non-produced drainage fluids having higher NCG content are substantially retained within the reservoir.

It is reasonable to assume that using fluid-inlet components to limit the flow of high gas-content drainage fluids will result in a commensurate decrease in oil production and/or solvent recovery. However, the results of the present disclosure indicate that this need not be the case. The methods of the present disclosure couple variations in the fluid-inlet configuration with pump-speed modulations, and the examples set out herein indicate that oil production rates can be maintained or even improved while simultaneously providing favourable liquid phase:gas phase ratios. Accordingly, the present disclosure provides a coordinated approach to configuring and/or operating the production well to provide alternative strategies that allow for a greater degree of control over the extent to which NCGs are produced during operation. For example, a threshold gas-production rate may be selected, and a method in accordance with the present disclosure may be implemented to achieve a target oil-production rate without violating the threshold. Likewise, a threshold oil-production rate may be selected, and a method in accordance with the present disclosure may be implemented to achieve a target NCG production rate without violating the threshold.

Select embodiments of the present disclosure relate to a method for producing hydrocarbons from a subterranean reservoir that is penetrated by an injection well and a production well. The production well comprises a substantially-horizontal section along which a plurality of fluid-inlet components are spaced apart to define a plurality of production-well fluid-inlet zones at least one of which is in hydraulic communication with the horizontal section of the production well. The method comprises injecting an injection fluid comprising a non-condensable gas into the reservoir, by way of the injection well, to drive steam, solvent, mobilized hydrocarbons, or a combination thereof to occupy one or more of the production-well fluid-inlet zones as a drainage fluid comprising a liquid phase and a gas phase. The gas phase of the drainage fluid comprises at least a portion of the non-condensable gas. The method further comprises producing a production fluid at a production-flow rate via a pump running at a pump speed and in hydraulic communication with the production fluid. The production fluid comprises at least a portion of the liquid phase of the drainage fluid and at least a portion of the gas phase of the drainage fluid such that the production fluid is defined by a liquid phase:gas phase ratio. The method further comprises orchestrating variations in one or more of the plurality of fluid-inlet components to modulate the liquid phase:gas phase ratio of the production fluid by prioritizing hydraulic communication with a subset of the plurality of production-well fluid-inflow zones, and orchestrating variations in the pump speed to modulate the production-flow rate and account for the variations in one or more of the plurality of fluid-inlet components.

Other aspects and features of the methods of the present disclosure will become apparent to those ordinarily skilled in the art upon review of the following description of specific embodiments.

BRIEF DESCRIPTION OF THE DRAWINGS

These and other features of the present disclosure will become more apparent in the following detailed description in which reference is made to the appended drawings. The appended drawings illustrate one or more embodiments of the present disclosure by way of example only and are not to be construed as limiting the scope of the present disclosure.

In FIG. 7A, the blowdown phase comprised four years of gas production at a rate of about 1,000 $m^3$/day. In FIG. 7B, the blowdown phase comprised one year of gas production at a rate of about 1,000 $m^3$/day and three years at a rate of about 10,000 $m^3$/day.

DETAILED DESCRIPTION

Figure 1:
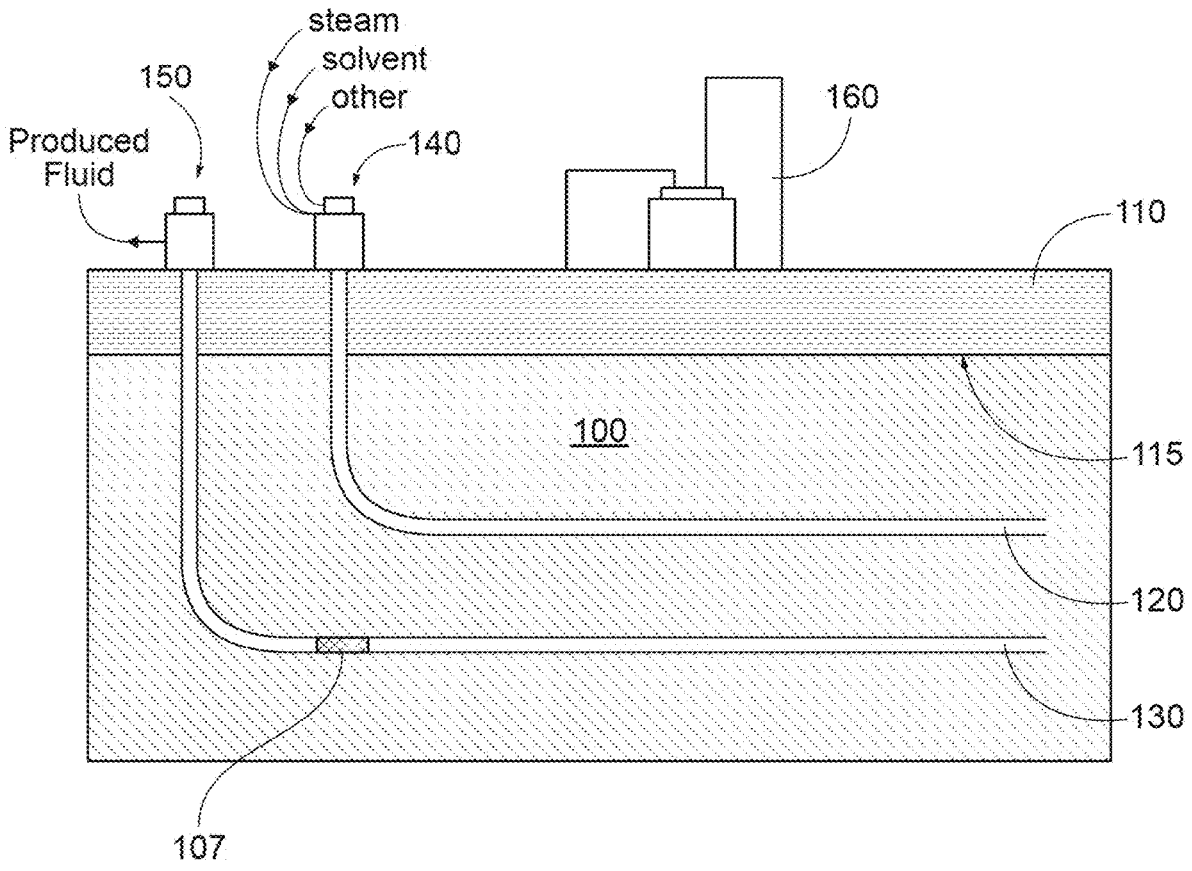
FIG. 1 shows a schematic illustration of a typical well pair configuration in a hydrocarbon reservoir, which are operable to implement an embodiment of the present disclosure.

During operation ramp-down and/or blowdown, preferential flow of non-condensable gas (NCG) rather than oil/water/emulsion can lead to inefficient operations. The present disclosure reports a coordinated approach to configuring and/or operating the production well so as to provide a greater degree of control over the extent to which NCGs are produced during ramp-down and/or blowdown. By employing fluid-inlet components that limit flow of high gas-content drainage fluids, the pool of drainage fluids surrounding the production well can be segmented into semi-localized fluid-inlet zones, such that NCG ingress can be mitigated. The semi-localized zones that are occupied by high-gas content drainage fluids can be deprioritized in favour of those semi-localized zones occupied by low gas-content drainage fluids. The present disclosure reports that modulating pump speed has a considerable impact on the cumulative flow through the flow-inlet components such that, counter to conventional wisdom, oil production can be maintained while NCG ingress kept below threshold levels. For example, the simulations set out herein indicate anticipated improvements in oil rates, gas rates, steam-oil ratios, solvent-oil ratios, and oil-recovery factors during ramp-down and/or blowdown.

In the context of the present disclosure, ramp-down and/or blowdown processes are those executed after a threshold production metric is reached that signals the potential for a decline in the profitability of the well. For example, ramp-down and/or blowdown may be triggered by a particular recovery factor (such as about 50% recovery of the estimated oil in place, 60% recovery of the estimated oil in place, or about 70% recovery of the estimated oil in place) or by a particular steam-oil ratio (such as greater that about 3.0, about 3.5, or about 4.0).

In the context of the present disclosure, ramp-down may comprise an iterative shift from an injection fluid composition primarily comprising steam and/or solvent to an injection mixture to an injection fluid composition primarily comprising NCG over the course of weeks or months. For example, during ramp-down the injection fluid may be transitioned from a first composition of about 100 wt. % steam and/or solvent and about 0 wt. % NCG to a second compositions comprising about 0 wt. % steam and/or solvent and about 100 wt. % NCG over a time period of between about 2 weeks and about 12 months. Alternatively, the first composition may comprise NCG, as NCG co-injection may be employed during production. For example, the first composition may comprise: (i) about 95 wt. % steam and/or solvent and about 5 wt. % NCG; (ii) about 90 wt. % steam and/or solvent and about 10 wt. % NCG; (iii) about 85 wt. % steam and/or solvent and about 15 wt. % NCG; or (iv) about 80 wt. % steam and/or solvent and about 20 wt. % NCG. Likewise, the second composition may comprise substantial amounts of steam and/or solvent. In particular, the second composition may comprise substantial amounts of steam if a significant amount of solvent was used during hydrocarbon production such that a late-life solvent-recovery protocol is desirable. For example, the second composition may comprise: (i) about 10 wt. % steam and about 90 wt. % NCG; (ii) about 20 wt. % steam and about 80 wt. % NCG; (iii) about 30 wt. % steam and about 70 wt. % NCG; or (iv) about 40 wt. % steam and about 60 wt. % NCG. With respect to the time period, a ramp-down protocol may last: (i) between about 2 weeks and about 2 months; (ii) between about 2 months and about 4 months; (iii) between about 4 months and about 8 months; or (iv) between about 8 months and about 12 months. A ramp-down protocol may be followed by a blow-down protocol as set out below.

In the context of the present disclosure, blowdown may comprise a shift from an injection fluid composition primarily comprising steam and/or solvent to an injection mixture to an injection fluid composition primarily comprising NCG over the course of less than two weeks and then maintained for a period of weeks or months. For example, during blowdown the injection fluid may be transitioned from a first composition of about 100 wt. % steam and/or solvent and about 0 wt. % NCG to a second compositions comprising about 0 wt. % steam and/or solvent and about 100 wt. % NCG over the course of about 2 weeks and then maintained for a time period between about 2 weeks and about 12 months. Alternatively, the first composition may comprise NCG, as NCG co-injection may be employed during production. For example, the first composition may comprise: (i) about 95 wt. % steam and/or solvent and about 5 wt. % NCG; (ii) about 90 wt. % steam and/or solvent and about 10 wt. % NCG; (iii) about 85 wt. % steam and/or solvent and about 15 wt. % NCG; or (iv) about 80 wt. % steam and/or solvent and about 20 wt. % NCG. Likewise, the second composition may comprise substantial amounts of steam and/or solvent. In particular, the second composition may comprise substantial amounts of steam if a significant amount of solvent was used during hydrocarbon production such that a late-life solvent-recovery protocol is desirable. For example, the second composition may comprise: (i) about 10 wt. % steam and about 90 wt. % NCG; (ii) about 20 wt. % steam and about 80 wt. % NCG; (iii) about 30 wt. % steam and about 70 wt. % NCG; or (iv) about 40 wt. % steam and about 60 wt. % NCG. With respect to the time period, a blowdown protocol may last: (i) between about 2 weeks and about 2 months; (ii) between about 2 months and about 4 months; (iii) between about 4 months and about 8 months; or (iv) between about 8 months and about 12 months. A blow-down protocol may be initiated directly after a production protocol, or after a ramp-down protocol.

In the context of the present disclosure, fluid-inlet components at the production well may include any type of component that prioritizes liquid flow over gas flow, such as inflow control devices (ICDs) and/or upper production ports (UPP). At a high level, ICDs/UPPs may use one or more restrictions to reduce flow and create pressure drop across the components. Higher pressure drops will be created as a result of higher flow rates (typically gas) which in turn, chokes off the production through that component. There are two main types of components: ones that are sensitive to fluid viscosity and ones that are sensitive to fluid density. Components that are sensitive to viscosity are typically long, narrow channels (helical shaped or long tubes) which are dominated by shear at the wall/fluid interface. components that use fluid density and flow rate to achieve a pressure drop, require restrictive ports (e.g. orifices or nozzles). ICDs are more sophisticated components with multiple configurations/designs and range from elongated nozzles, to complex tortuous path designs. UPPs, on the other hand, are very simple designs which incorporate holes drilled into tubing that are appropriately sized. Both ICDs and UPPs may be implemented in the methods of the present disclosure, as set out below.

In the context of the present disclosure, ICDs may comprise shiftable ports that can be closed remotely using coiled tubing or other means of actuation. The ports in any particular compartment can then be closed when high gas flows are detected based on distributed acoustic sensing (DAS) and/or distributed temperature sensing (DTS) for instance or can be closed at predetermined times based on well trajectories and times when gas flow at particular locations are expected to become problematic such as high spots in the production well or sections where there are nearby production wells at lower elevations. Alternatively, ICDs may be autonomous inflow control devices/valves (AICD/AICV) which can close or restrict flow based on the nature of the fluid flowing. Autonomous valves may be designed to restrict or shut off flow whenever gas production reached a threshold level and so could automatically limit gas flow from any compartment of the well pair where gas volumes became problematic. Under reservoir conditions, gas tends to flow with significantly less resistance than oil, water, or emulsion, for example because of the volumetric constraints associated with small reservoir pore spaces and the low dynamic viscosities characteristic of reservoir gases. When gas flows into a production well at a particular location then it can limit the ability to produce oil and water from other locations along the same production well (as by applying more drawdown/pressure drop more gas is pulled into the production well at that location preferentially to liquids from other locations). By compartmentalizing the well (preventing/restricting flow along the annulus between the tubing and the liner) and shutting off or restricting flow from the liner to the tubing in the compartments where high gas-concentration fluids are entering the liner, then more drawdown/pressure drop can be applied and will pull in more fluid from the segments of the well occupied by low gas-concentration fluids.

In select embodiments of the present disclosure, the ICDs may be coupled to the liner so that gas-phase flow into the liner is controlled. In such embodiments, a production-tubing string may not be required in the horizontal section of the production well.

In select embodiments of the present disclosure, the ICDs may be coupled to a production-tubing string within the production well. With this configuration, fluids inside the production-tubing string may be in hydraulic communication with the pump inlet. In such embodiments, communication between ICDs on the outside of the tubing may be restricted by annulus-flow restrictors.

In the context of the present disclosure, annulus-flow restrictors are used to restrict the movement of gases along the annular space into the next port or device. Without such restriction, gases that fail to pass into the production-tubing string at one location may flow along the annulus to another inlet point, and this may compromise the isolation of the plurality of production-well fluid-inlet zones. In select embodiments of the present disclosure, one or more of the annulus-flow restrictors may be reduced flow areas created by physical restriction or by pressure gradients resulting from flow or gravity based on the configuration of the tubing and the location of the devices. Depending on the configuration of the production well, pressure gradients from excess gas flowing along the annular space to the next point of entry may be enough to limit how much of the gas is able to flow along the annulus and in through the adjacent ICD—especially If the ICDs are spaced well apart and/or the annular space is small due to large production tubing (or coupling) outer diameter relative to the liner inner diameter.

In select embodiments, one or more of the annulus-flow restrictors may comprise one or more packers. As will be appreciated by those skilled in the art who have benefitted from the teachings of the present disclosure, while packers may take a variety of forms, they are typically designed to segregate flow within the annulus.

Select embodiments of the present disclosure relate to a method for producing hydrocarbons from a subterranean reservoir that is penetrated by an injection well and a production well. The production well comprises a substantially-horizontal section along which a plurality of fluid-inlet components are spaced apart to define a plurality of production-well fluid-inlet zones at least one of which is in hydraulic communication with the horizontal section of the production well. The method comprises injecting an injection fluid comprising a non-condensable gas into the reservoir, by way of the injection well, to drive steam, solvent, mobilized hydrocarbons, or a combination thereof to occupy one or more of the production-well fluid-inlet zones as a drainage fluid comprising a liquid phase and a gas phase. The gas phase of the drainage fluid comprises at least a portion of the non-condensable gas. The method further comprises producing a production fluid at a production-flow rate via a pump running at a pump speed and in hydraulic communication with the production fluid. The production fluid comprises at least a portion of the liquid phase of the drainage fluid and at least a portion of the gas phase of the drainage fluid such that the production fluid is defined by a liquid phase:gas phase ratio. The method further comprises orchestrating variations in one or more of the plurality of fluid-inlet components to modulate the liquid phase:gas phase ratio of the production fluid by prioritizing hydraulic communication with a subset of the plurality of production-well fluid-inflow zones, and orchestrating variations in the pump speed to modulate the production-flow rate and account for the variations in one or more of the plurality of fluid-inlet components.

In select embodiments of the present disclosure, the plurality of fluid-inlet components comprises one or more inflow-control devices. In select embodiments of the present disclosure, the one or more inflow-control devices comprise shiftable ports that are configured for remote operation. In select embodiments of the present disclosure, the shiftable ports are actuated in response to changes in distributed acoustic sensing (DAS) and/or distributed temperature sensing (DTS). In select embodiments of the present disclosure, the shiftable ports are actuated in response to changes in the liquid phase:gas phase ratio of the production fluid.

In select embodiments of the present disclosure, the one or more inflow-control devices are autonomous inflow-control devices.

In select embodiments of the present disclosure, the plurality of fluid-inlet components comprises one or more upper production ports.

In select embodiments of the present disclosure, the plurality of fluid-inlet components are spaced along the substantially-horizontal section of the production well to define between about two and about eight production-well fluid-inlet zones. For example, the substantially-horizontal section of the production well may be about 1,000 m, and the fluid-inlet components may be spaced apart by about 50 m to about 500 m. In select embodiments, the fluid-inlet components may be spaced apart at substantially equal distances, or the fluid-inlet components may be spaced apart at non-equal distances (such as to account for changes in reservoir geology and/or well trajectory).

In select embodiments of the present disclosure, one or more of the fluid-inlet components are interposed between annulus-flow restrictors. In select embodiments of the present disclosure, the annulus-flow restrictors comprise packers.

In select embodiments of the present disclosure, orchestrating variations in the pump speed and one or more of the plurality of fluid-inlet components the pump speed comprises adjusting parameters such that the average gas-production rate is between: (i) about 1,000 $m^3$/day and about 30,000 $m^3$/day under STP conditions, (ii) about 10,000 $m^3$/day and about 30,000 $m^3$/day under STP conditions, or (iii) about 20,000 $m^3$/day and about 30,000 $m^3$/day under STP conditions. Those skilled in the art who have benefitted from the teachings of the present disclosure will appreciate that target gas-production rates may be adjusted in response to a variety of factors such as gas-treatment capacity and/or gas-production rates from adjacent well pairs. In the context of the present disclosure, there is also scope to change the pumping system design to allow better gas separation which may accommodate higher gas-production rates (with commensurate increases in oil/emulsion production) by avoiding a surface limitation. For example, improved phase separation at the pump may increase the fraction of gas flow up the casing, where there may be fewer limitations relative to gas that is produced via the production string.

In select embodiments of the present disclosure, the liquid phase:gas phase ratio of the production fluid is between: (i) about 1:100 and about 1:1, (ii) about 1:80 and about 1:20, or (iii) about 1:60 and about 1:40.

In select embodiments of the present disclosure, at least one of the plurality of production-well fluid-inlet zones has a temperature of between: (i) about 50° C. and about 300° C., (ii) about 70° C. and about 250° C., or (iii) about 120° C. and about 200° C.

In select embodiments of the present disclosure, NCG accounts for between about 50% and about 100% of the injection fluid on a mass basis during ramp down and/or blowdown.

In select embodiments of the present disclosure, NCG is methane, flue gas, $CO_2$, $O_2$, $N_2$, or a combination thereof.

In select embodiments of the present disclosure, the subterranean reservoir is a thin pay reservoir having an average height of between about 5 m and about 15 m.

Embodiments of the present disclosure will now be described by reference to FIG. 1 to FIG. 14.

FIG. 1 schematically illustrates a typical well pair configuration in a hydrocarbon reservoir 100, which can be operated to implement an embodiment of the present disclosure. The well pair may be configured and arranged similar to a typical well pair configuration for SAGD operations.

As illustrated, the reservoir 100 contains heavy hydrocarbons below an overburden 110. Under natural conditions before any treatment, reservoir 100 is at a relatively low temperature, such as about 12° C., and the reservoir pressure may be from about 0.1 to about 4 MPa, depending on the location and other characteristics of the reservoir.

The well pair includes an injection well 120 and a production well 130, which have horizontal sections extending substantially horizontally in reservoir 100, and which are drilled and completed for injecting injection fluids and producing hydrocarbons from reservoir 100. As depicted in FIG. 1, the well pair is typically positioned away from the overburden 110 and near the bottom of the pay zone or geological stratum in reservoir 100, as can be appreciated by those skilled in the art.

As is typical, injection well 120 may be vertically spaced from production well 130, such as at a distance of about 3 m to about 8 m, e.g., about 5 m. The distance between the injection well and the production well may vary and may be selected to optimize the operation performance within technical and economical constraints, as can be understood by those skilled in the art. In select embodiments of the present disclosure, the horizontal sections of wells 120 and 130 may have a length of about 800 m. In other embodiments, the length may be varied as can be understood and selected by those skilled in the art. Wells 120 and 130 may be configured and completed according to any suitable techniques for configuring and completing horizontal in situ wells known to those skilled in the art. Injection well 120 and production well 130 may also be referred to as the "injection well" and "production well", respectively.

The overburden 110 may be a cap layer or cap rock. Overburden 110 may be formed of a layer of impermeable material such as clay or shale. A region in the reservoir 100 just below and near overburden 110 may be considered as an interface region 115.

As illustrated, wells 120 and 130 are connected to respective corresponding surface facilities, which typically include an injection surface facility 140 and a production surface facility 150. Surface facility 140 is configured and operated to supply injection fluids, such as steam and solvent, into injection well 120. Surface facility 150 is configured and operated to produce fluids collected in production well 130 to the surface. Each of surface facilities 140, 150 includes one or more fluid pipes or tubing for fluid communication with the respective well 120 or 130. As depicted for illustration, surface facility 140 may have a supply line connected to a steam generation plant for supplying steam for injection, and a supply connected to a solvent source for supplying the solvent for injection. Optionally, one or more additional supply lines may be provided for supplying other fluids, additives or the like for co-injection with steam or the solvent. Each supply line may be connected to an appropriate source of supply (not shown), which may include, for example, a steam generation plant, a boiler, a fluid mixing plant, a fluid treatment plant, a truck, a fluid tank, or the like. In select embodiments of the present disclosure, co-injected fluids or materials may be pre-mixed before injection. In other embodiments, co-injected fluids may be separately supplied into injection well 120. In particular, surface facility 140 is used to supply steam and a selected solvent into injection well 120. The solvent may be pre-mixed with steam at surface before co-injection. Alternatively, the solvent and steam may be separately fed into injection well 120 for injection into formation 100. Optionally, surface facility 140 may include a heating facility (not separately shown) for pre-heating the solvent before injection.

As illustrated, surface facility 150 includes a fluid transport pipeline for conveying produced fluids to a downstream facility (not shown) for processing or treatment. Surface facility 150 includes necessary and optional equipment for producing fluids from production well 130, as can be understood by those skilled in the art. An embodiment of surface facility 150 includes one or more valves for regulating the fluid flow in the liquid line of the produced fluid. The valve(s) may be a choke valve, such as an inline globe valve. The valve may be selected and configured to control the "backpressure" and the flow rate in the liquid line (also referred to as the emulsion line in the art).

Other necessary or optional surface facilities 160 may also be provided, as can be understood by those skilled in the art. For example, surface facilities 160 may include one or more of a pre-injection treatment facility for treating a material to be injected into the formation, a post-production treatment facility for treating a produced material, a control or data processing system for controlling the production operation or for processing collected operational data. Surface facilities 140, 150 and 160 may also include recycling facilities for separating, treating, and heating various fluid components from a recovered or produced reservoir fluid. For example, the recycling facilities may include facilities for recycling water and solvents from produced reservoir fluids.

Injection well 120 and production well 130 may be configured and completed in any suitable manner as can be understood or is known to those skilled in the art, so long as the wells are compatible with injection and recovery of heavy hydrocarbons. For example, in different embodiments, the well completions may include perforations, slotted liner, screens, and/or outflow control devices such as in injection well 120. For simplicity, other necessary or optional components, tools or equipment that are installed in the wells are not shown in the drawings as they are not particularly relevant to the present disclosure.

Figure 2:
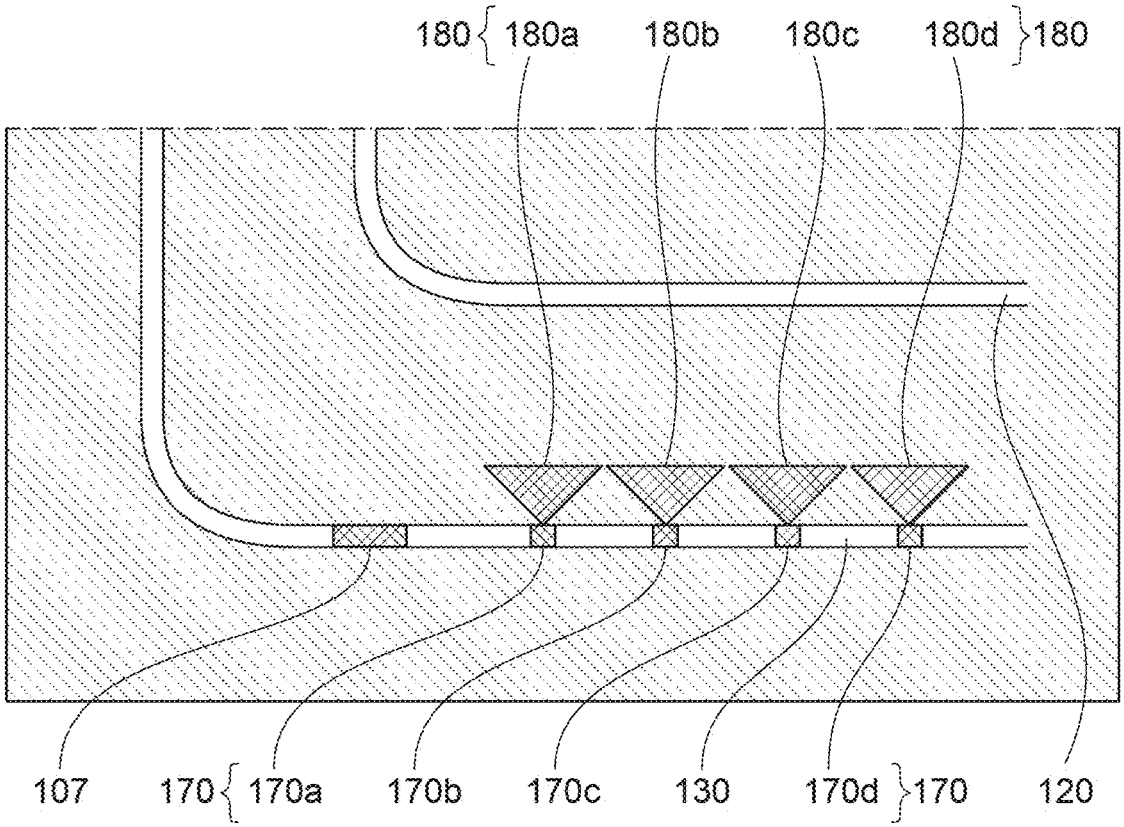
FIG. 2 shows an expansion of the schematic of FIG. 1, with additional details provided with respect to the production well.

FIG. 2 shows an expansion of the schematic of FIG. 1, with additional details provided with respect to production well 130. In, FIG. 2, production well 130 comprises a pump 107 for producing fluids to facility 150. Production well 130 further comprises a plurality of flow-inlet components 170. Individual flow-inlet components 170*a*, 170*b*, 170*c*, and 170*d* are referenced in FIG. 2 as units in the plurality of flow-inlet components 170, and they are spaced apart along the horizontal section of production well 130. In select embodiments of the present disclosure, individual flow-inlet components may be interposed between annulus-flow restrictors (e.g. packers). The plurality of inflow control devices are configured to uptake produced fluid into production well 130, and at least one of the plurality of inflow control devices is in hydraulic communication with the reservoir 100. In particular, injection fluid and mobilized hydrocarbons may collect as drainage fluids in proximity to the production well 130. Hydraulic communication between collections of drainage fluids and the plurality of flow-inlet components 170 results in a plurality of production-well fluid-inlet zones 180. Individual production-well fluid-inlet zones 180*a*, 180*b*, 180*c*, and 180*d* are referenced in FIG. 2 as discrete components of the plurality of production-well fluid-inlet zones 180, however, two or more production-well fluid-inflow zones may be in hydraulic communication with each other. Nonetheless, as set out in detail below, the drainage fluids occupying adjacent production-well fluid-inflow zones may have different gas phase:liquid phase ratios, such that reducing flow through one or more of the plurality of fluid-inlet components 170 while simultaneous operating pump 107 to move produced fluids towards surface facility 150 may result in improved production metrics. Accordingly, in the context of the present disclosure, the plurality of production-well fluid-inlet zones 180 may be considered to be semi-localized.

The methods of the present disclosure may be executed as part of a broader production lifecycle comprising a start-up phase, a ramp-up phase, a production phase, and a ramp-down/blowdown phase. In an exemplary start-up phase, fluid communication between wells 120 and 130 is established in a manner that may be similar to the initial start-up phase in a conventional SAGD process. To permit drainage of mobilized hydrocarbons and condensate to production well 130, fluid communication between wells 120, 130 must be established. Fluid communication refers to fluid flow between the injection and production wells. Establishment of such fluid communication typically involves mobilizing viscous hydrocarbons in the reservoir to form a drainage fluid and removing the drainage fluid to create a porous pathway between the wells. In the context of the present disclosure, a drainage fluid may comprise a liquid phase and a gas phase, and the liquid phase may comprise mobilized hydrocarbons. To form a drainage fluid, viscous hydrocarbons may be mobilized by heating such as by injecting or circulating pressurized steam or hot water through injection well 120 or production well 130. In some cases, steam may be injected into, or circulated in, both injection well 120 and production well 130 for faster start-up. A pressure differential may be applied between injection well 120 and production well 130 to promote steam/hot water penetration into the porous reservoir area that lies between the wells of the well pair. The pressure differential may promote fluid flow and convective heat transfer to facilitate communication between the wells.

As is typical, the injection and production wells 120, 130 have terminal sections that are substantially horizontal and substantially parallel to one another. A person of skill in the art will appreciate that while there may be some variation in the vertical or lateral trajectory of the injection or production wells, causing increased or decreased separation between the wells, such wells for the purpose of this application will still be considered substantially horizontal and substantially parallel to one another. Spacing, both vertical and lateral, between injection wells and production wells may be optimized for establishing start-up or based on reservoir conditions.

Additionally or alternatively, other techniques may be employed during the start-up phase. For example, to facilitate fluid communication, a solvent may be injected into the reservoir region around and between the injection and production wells 120, 130. The region may be soaked with a solvent before or after steam injection. An example of start-up using solvent injection is disclosed in CA 2,698,898. In further examples, the start-up phase may include one or more start-up processes or techniques disclosed in CA 2,886,934, CA 2,757,125, or CA 2,831,928.

Once fluid communication between injection well 120 and production well 130 has been achieved, oil production or recovery may commence. As the oil production rate is typically low initially and will increase as the production chamber develops, the early production phase is known as the "ramp-up" phase. During the ramp-up phase, steam, with or without a solvent, is typically injected continuously into injection well 120, at constant or varying injection pressure and temperature. At the same time, drainage fluids comprising mobilized heavy hydrocarbons and aqueous condensate are continuously removed from production well 130. During ramp-up, the zone of communication between injection well 120 and production well 130 may continue to expand axially along the full length of the horizontal portions of wells 120, 130.

As the injected fluid heats up reservoir 100, heavy hydrocarbons in the heated region are softened, resulting in reduced viscosity. Further, as heat is transferred from steam to reservoir 100, steam and solvent vapour condense. The aqueous and solvent condensate and mobilized hydrocarbons will drain downward due to gravity. As a result of depletion of the heavy hydrocarbons, a porous region is formed in reservoir 100, which is referred to herein as a "production chamber". When a production chamber is filled with mainly steam, it is commonly referred to in the art as a "steam chamber."

At the point of injection into the reservoir 100, or in the injection well 120, the injected fluid/mixture may be at a temperature that is selected to optimize the production performance and efficiency. For example, for a given solvent to be injected the injection temperature may be selected based on the boiling point (or saturation) temperature of the solvent at the expected operating pressure in the reservoir. For propane, the boiling temperature is about 2° C. at about 0.5 MPa, and about 77° C. at about 3 MPa. For a different solvent, the injection temperature may be higher if the boiling point temperature of that solvent at the reservoir pressure is higher. In different embodiments and applications, the injection temperature may be substantially higher than the boiling point temperature of the solvent by, e.g., 5° C. to 200° C., depending on various operation and performance considerations. In some embodiments, the injection temperature may be from about 50° C. to about 320° C., and at a pressure from about 0.5 MPa to about 12.5 MPa, such as from about 0.6 MPa to about 5.1 MPa or up to about 10 MPa. At an injection pressure of about 3 MPa, the injection temperature for propane may be from about 80° C. to about 250° C., and the injection temperature for butane may be from about 100° C. to about 300° C. The injection temperature and pressure are referred to as injection conditions. A person skilled in the art will appreciate that the injection conditions may vary in different embodiments depending on, for example, the type of hydrocarbon recovery process implemented or the mobilizing agents selected, as well as various factors and considerations for balancing and optimizing production performance and efficiency. The injection temperature should not be too high as a higher injection temperature will typically require more heating energy to heat the injected fluid. Further, the injection temperature should be limited to avoid coking hydrocarbons in the reservoir formation. In some oil sands reservoirs, the coking temperature of the bitumen in the reservoir is about 350° C.

Once injected steam and vapour of the injected solvent enter the reservoir, their temperature may drop under the reservoir conditions. The temperatures at different locations in the reservoir will vary as typically regions further away from injection well 120, or at the edges of the production chamber, are colder. During operations, the reservoir conditions may also vary. For example, the reservoir temperatures can vary from about 10° C. to about 275° C., and the reservoir pressures can vary from about 0.6 MPa to about 7 MPa depending on the stage of operation. The reservoir conditions may also vary in different embodiments. As noted above, injected steam and solvent condense in the reservoir mostly at regions where the reservoir temperature is lower than the dew point temperature of the solvent at the reservoir pressure. Condensed steam (water) and solvent can mix with the mobilized bitumen to form drainage fluids. It is expected that in a typical reservoir subjected to steam/solvent injection, the drainage fluids include a stream of condensed steam (or water, referred to as the water stream herein). The water stream may flow at a faster rate (referred to as the water flow rate herein) than a stream of mobilized bitumen containing oil (referred to as the oil stream herein), which may flow at a slower rate (referred to as the oil flow rate herein). The drainage fluids can be drained to the production well by gravity. The mobilized bitumen may still be substantially more viscous than water, and may drain at a relatively low rate if only steam is injected into the reservoir. However, condensed solvent may dilute the mobilized bitumen and increase the flow rate of the oil stream.

Thus, injected steam and vapour of the solvent both assist to mobilize the viscous hydrocarbons in the reservoir 100. A drainage fluid formed in the production chamber may include oil, condensed steam (water), and a condensed phase of the solvent. The reservoir fluid is drained by gravity along the edge of production chamber into production well 130 for recovery of oil.

In various embodiments, the solvent may be selected so that dispersion of the solvent in the production chamber, as well as in the drainage fluid increases the amount of oil contained in the fluid and increases the flow rate of oil stream from production chamber to the production well 130. When solvent condenses (forming a liquid phase) in the production chamber, it can be dispersed in the drainage fluid to increase the rate of drainage of the oil stream from the reservoir 100 into the production well 130.

After the produced fluids are surfaced, the solvent and water may be separated from oil in the produced fluids by a method known in the art depending on the particular solvent(s) involved. The separated water and solvent can be further processed by known methods, and recycled to the injection well 120. In some embodiments, the solvent is also separated from the produced water before further treatment, re-injection into the reservoir, or disposal.

As mentioned above, the production chamber forms and expands due to depletion of hydrocarbons and other in situ materials from regions of reservoir 100 above the injection well 120. Injected steam/solvent vapour tend to rise up to reach the top of production chamber before they condense, and steam/solvent vapour can also spread laterally as they travel upward. During early stages of chamber development, the production chamber expands upwardly and laterally from injection well 120. During the ramp-up phase and the early production phase, the production chamber can grow vertically towards overburden 110.

At later phases, after the production chamber has reached the overburden 110, the production chamber may expand mainly laterally. Depending on the size of reservoir 100 and the pay therein and the distance between injection well 120 and overburden 110, it can take a long time, such as many months and up to two years, for the production chamber to reach overburden 110, when the pay zone is relative thick as is typically found in some operating oil sands reservoirs. However, it will be appreciated that in a thinner pay zone, the production chamber can reach the overburden sooner. The time to reach the vertical expansion limit can also be longer in cases where the pay zone is higher or highly heterogeneous, or the formation has complex overburden geologies such as with inclined heterolithic stratification (HIS), top water, top gas, or the like.

The start-up, ramp-up, and production phases may be conducted according to any suitable conventional techniques known to those skilled in the art except the aspects described herein, and the other aspects will therefore not be detailed herein for brevity. As an example, during production, such as at the end of an initial production period with steam injection, the formation temperature in the production chamber can reach about 235° C. and the pressure in the production chamber may be about 3 MPa. The temperature or pressure may vary by about 10% to about 20%.

In the methods of the present disclosure, ramp-down and/or blowdown may be initiated after a threshold production metric is reached that signals the potential for a decline in the profitability of the well. For example, ramp-down and/or blowdown may be triggered by a recovery factor of about 60% recovery of the estimated oil in place or by a steam-oil ratio greater than about 3.5.

In the methods of the present disclosure, the coordinated approach to configuring and/or operating the production well provides a greater degree of control over the extent to which NCGs are produced during ramp-down and/or blowdown. By employing fluid-inlet components that limit flow of high gas-content drainage fluids, the pool of drainage fluids surrounding the production well during ramp-down and/or blowdown can be segmented into semi-localized fluid-inlet zones, such that NCG ingress can be mitigated. The semi-localized zones that are occupied by high-gas content drainage fluids can be deprioritized in favour of those occupied by low gas-content drainage fluids. Likewise, during ramp-down and/or blowdown in the methods of the present disclosure, the pump speed is to modulated to influence the cumulative flow through the flow-inlet components such that oil production can be maintained while NCG ingress kept below threshold levels. For example, the simulations set out herein indicate potential improvements in oil rates, gas rates, steam-oil ratios, solvent-oil ratios, and oil-recovery factors during ramp-down and/or blowdown.

As noted above, in the methods of the present disclosure ramp-down may comprise an iterative shift from an injection fluid composition primarily comprising steam and/or solvent to an injection mixture to an injection fluid composition primarily comprising NCG over the course of weeks or months. For example, during ramp-down the injection fluid may be transitioned from a first composition of about 100 wt. % steam and/or solvent and about 0 wt. % NCG to a second compositions comprising about 0 wt. % steam and/or solvent and about 100 wt. % NCG over a time period of between about 8 months.

Likewise, as noted above, in the methods of the present disclosure, In the context of the present disclosure, blowdown may comprise a shift from an injection fluid composition primarily comprising steam and/or solvent to an injection mixture to an injection fluid composition primarily comprising NCG over the course of less than two weeks and then maintained for a period of weeks or months. For example, during blowdown the injection fluid may be transitioned from a first composition of about 100 wt. % steam and/or solvent and about 0 wt. % NCG to a second compositions comprising about 0 wt. % steam and/or solvent and about 100 wt. % NCG over the course of less than about 2 weeks and then maintained for a time period between about 8 months.

Suitable NCGs for ramp-down and/or blowdown may comprise methane, flue gas, $CO_2$, $O_2$, $N_2$, or a combination thereof.

EXAMPLES

State-of-the-art simulation protocols were used to compare an archetypal method of the present disclosure to a conventional process using a well characterized field well to set reservoir parameters. Average properties for the well are set out in Table 1.

TABLE 1

Simulation properties for comparison of a conventional method with a method in accordance with the present disclosure.

| Property | Units | Value |
|---|---|---|
| Solid | N/A | McMurray Sand |
| KH | D | 0-6 |
| KV | D | 0-5 |
| Porosity | N/A | 0-0.33 |
| Pay Thickness | m | 20 |
| Well Length | m | 900 |
| Well spacing | m | 100 |

Figure 3:
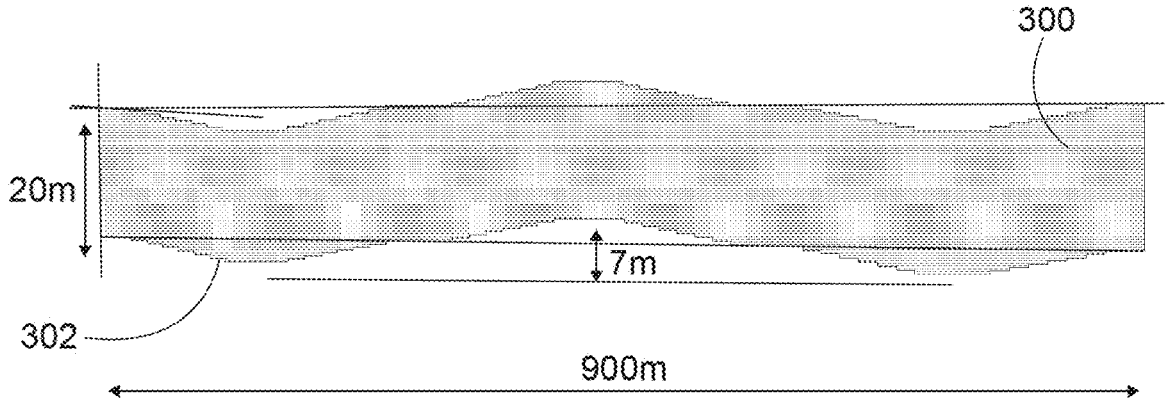
FIG. 3 shows a profile view of the simulation reservoir used for comparison of a conventional SAGD blowdown method with a method in accordance with the present disclosure.

FIG. 3, shows a profile view of the simulation reservoir used for comparison of a conventional SAGD blowdown method with a method in accordance with the present disclosure. The reservoir has a pay identified with reference number 300, and the pay 300 undulates vertically by about 3.5 m as shown. The pay has a base identified by reference number 302. The pay 300 is penetrated by a production well (not shown) that undulates to maintain a vertical spacing of about 1 m from the base 302. The pay 300 is also penetrated by an injection well (not shown) that undulates to maintain a vertical spacing of about 5 m from the production well.

Blowdown Method Using a Conventional SAGD Completion

Simulations were conducted for a conventional SAGD blowdown method in the reservoir of FIG. 3 as set out below with reference to FIG. 4-FIG. 7.

Figure 4:
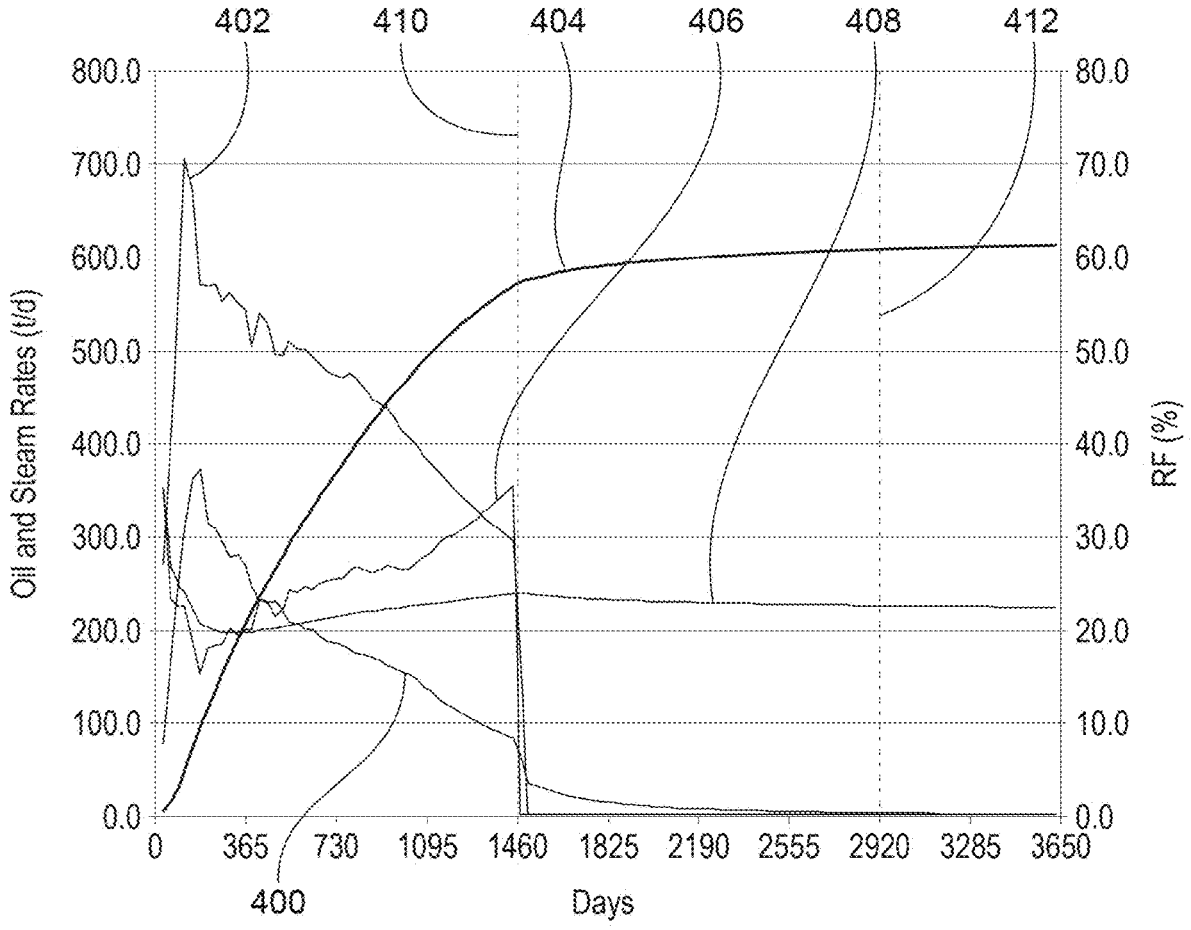
FIG. 4 shows plots of various blowdown parameters as a function of time for a conventional SAGD blowdown method employing a blowdown gas-production rate of about 1,000 $m^3$/day.

FIG. 4 shows plots of various blowdown parameters as a function of time for a conventional SAGD blowdown method employing a blowdown gas-production rate of about 1,000 $m^3$/day. In FIG. 4, oil production rate, steam injection rate, and recovery factor plots are indicated by reference numbers 400, 402, and 404, respectively. In FIG. 4, the instantaneous steam oil ratio (10×iSOR) and the cumulative steam oil ratio (10×cSOR) plots are indicated by reference numbers 406 and 408, respectively. In FIG. 4, the start of the blowdown phase is indicated by reference number 410 (about four years from the start of production), and the end of the blowdown phase is indicated with reference number 412 (about four years from the start of the blowdown phase). As shown in FIG. 4, at the start of the blowdown phase 410, the recovery factor 404 is about 57%, the iSOR 406 is about 3.6, and the oil production rate 400 is about 80 $m^3$/day. As shown in FIG. 4, the recovery factor 404 at the end of the blowdown phase 412 is about 61%, and the oil production rate 400 is less than about 25 bbl/day for the majority of the blowdown phase.

Figure 5A:
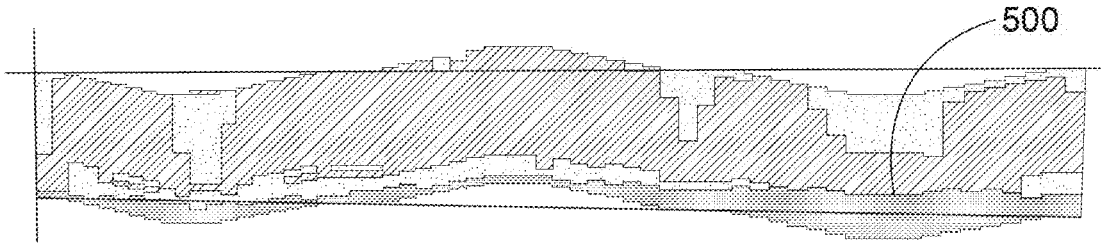
FIG. 5A and FIG. 5B show the pay of FIG. 3 in profile view one year into the blowdown phase and four years into the blowdown phase, respectively, of a conventional SAGD blowdown method.
Figure 5B:
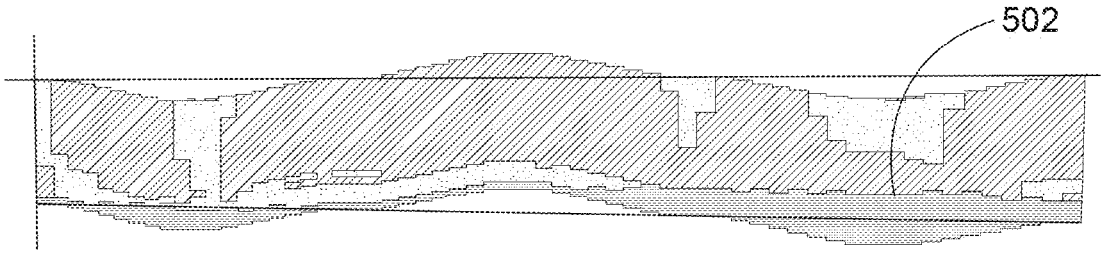

FIG. 5A and FIG. 5B show the pay 300 of FIG. 3 in profile view one year into the blowdown phase and four years into the blowdown phase, respectively, of a conventional method as described with reference to FIG. 4. In FIG. 5A and FIG. 5B, fluid density is indicated by saturation gradient, where darker shades indicate low-gas concentration fluids (i.e. emulsion rich) and lighter shades indicate high gas-concentration fluids (i.e. emulsion poor). In FIG. 5A and FIG. 5B, the emulsion levels vary along the lengths of the wells as generally indicated by reference numbers 500 and 502, respectively. Comparing the emulsion level 500 after one year of blowdown (FIG. 5A) and the emulsion level 502 after four years of blowdown (FIG. 5B), suggests that emulsion levels remain relatively constant during conventional blowdown methods based off gas production rates of about 1,000 $m^3$/day.

Figure 6:
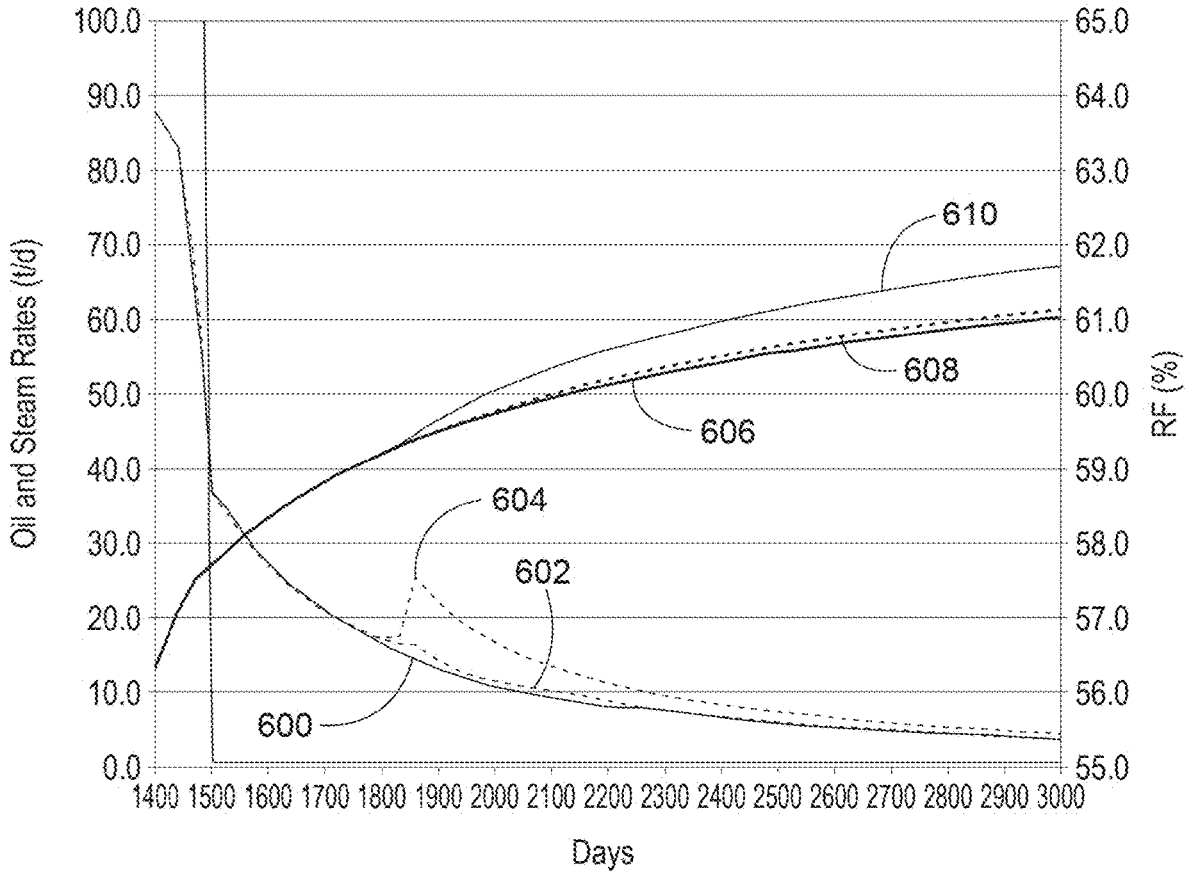
FIG. 6 shows plots of various blowdown parameters as a function of time for a conventional SAGD blowdown method employing blowdown gas-production rates of about 1,000 $m^3$/day, about 3,000 $m^3$/day, and about 10,000 $m^3$/day.

FIG. 6 illustrates how increasing the gas-production rate used during conventional blowdown methods may impact production. FIG. 6 shows plots of various blowdown parameters as a function of time for a conventional SAGD blowdown method based off a blowdown gas-production rates of about 1,000 $m^3$/day, 3,000 $m^3$/day, and 10,000 $m^3$/day. In FIG. 6, oil production rate plots indicated by reference numbers 600, 602, and 604, relate to gas-production rates of about 1,000 $m^3$/day, about 3,000 $m^3$/day, and about 10,000 $m^3$/day, respectively. As seen is FIG. 6, increasing gas production from 1,000 $m^3$/day to 3,000 $m^3$/day leads to a minimal increase in oil production rate (plot 600 vs 602). As seen is FIG. 6, increasing gas production from about 1,000 $m^3$/day to about 10,000 $m^3$/day leads to significantly higher in oil production rate, however the increase dissipates over time (plot 600 vs 604) such that the incremental recovery is less than about 1% by the end of the blowdown phase. This phenomenon is also evident in the related recovery factor plots. In FIG. 6, recovery factor plots based on gas-production rates of about 1,000 $m^3$/day, about 3,000 $m^3$/day, and about 10,000 $m^3$/day, are indicated by reference numbers 606, 608, and 610, respectively. For sake of clarity, the gas injection rates required to support gas production rates of about 1,000 $m^3$/day, about 3,000 $m^3$/day, and about 10,000 $m^3$/day are not shown in FIG. 6, however the results indicate that increasing gas production requires commensurate increases in gas injection rates. Accordingly the marginal benefits achieved with respect to oil-production rates may be weighed against the drawbacks associated with increased gas-production rates and gas-injection rates when executing conventional SAGD blowdown methods.

Figure 7A:
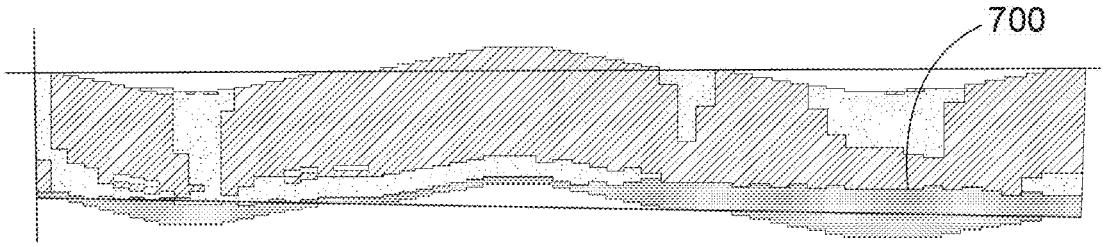
FIG. 7A and FIG. 7B show the pay of FIG. 3 in profile view four years into the blowdown phase of a conventional SAGD blowdown method.
Figure 7B:
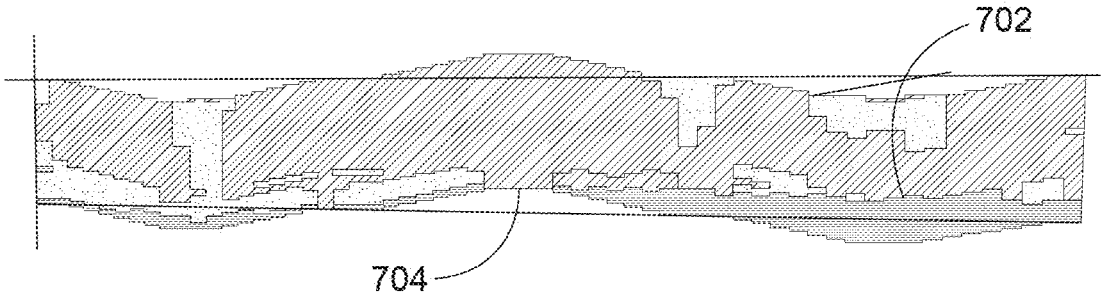

FIG. 7A and FIG. 7B show the pay 300 of FIG. 3 in profile view four years into the blowdown phase of a conventional method as described with reference to FIG. 6. In FIG. 7A, the blowdown phase comprised four years of gas production at a rate of about 1,000 $m^3$/day. In FIG. 7B, the blowdown phase comprised one year of gas production at a rate of about 1,000 $m^3$/day and three years at a rate of about 10,000 $m^3$/day. In FIG. 7A and FIG. 7B, fluid density is indicated by saturation gradient, where darker shades indicate low-gas concentration fluids (i.e. emulsion rich) and lighter shades indicate high gas-concentration fluids (i.e. emulsion poor). In FIG. 7A and FIG. 7B, the emulsion levels vary along the lengths of the wells as indicated by reference numbers 700 and 702, respectively. Comparing the emulsion level 700 (FIG. 7A) and the emulsion level 702 (FIG. 7B), suggests that emulsion levels drop by about 1 m with the increased gas production. Importantly, FIG. 7B also indicates the potential for the emulsion level 702 to drop below the production well as indicated by reference number 704. This high point is a potential entry point for gas to pass into the production well, which may be problematic with respect to managing the liquid phase:gas phase ratio of the production fluid.

Blowdown Method in Accordance with the Present Disclosure

Simulations were conducted for a method of the present disclosure in the reservoir of FIG. 3 as set out below with reference to FIG. 8 to FIG. 10. The production well was simulated as having a completion package that included production tubing with two ports (one in proximity to each of the low points shown in FIG. 3), and four packers (one on each side of each port, and each spaced about 100 m from their respective ports).

Figure 8:
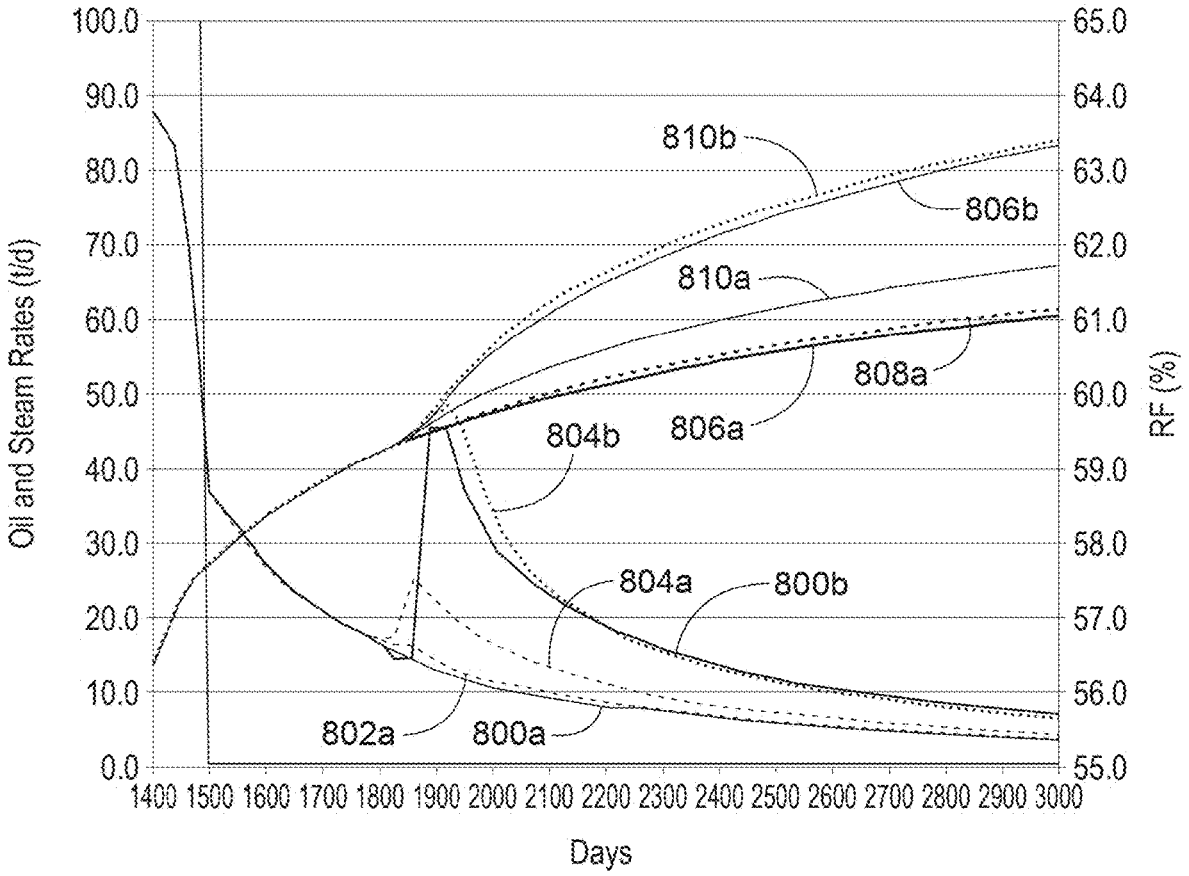
FIG. 8 shows plots of various blowdown parameters as a function of time for methods in accordance with the present disclosure as compared to those used in conventional blowdown methods.

FIG. 8 shows plots of various blowdown parameters as a function of time for methods in accordance with the present disclosure as compared to those used in conventional blowdown methods (as set out above with reference to FIG. 6). The plots in FIG. 8 are indicated by the reference numbers set out in Table 2. Equivalent parameters are indicated with like reference numbers. Those associated with conventional methods include the suffix "a", while those associated with methods in accordance with the present disclosure include the suffix "b".

TABLE 2

Reference numbers for plots of various blowdown parameters as a function of time in FIG. 8 (reference numbers for conventional methods include the suffix "a", while those associated with methods in accordance with the present disclosure include the suffix "b").

| Plot as a function of time | Reference Number(s) |
|---|---|
| Oil production rate based on gas production of 1,000 $m^3$/day | 800a/800b |
| Oil production rate based on gas production of 3,000 $m^3$/day | 802a |
| Oil production rate based on gas production of 10,000 $m^3$/day | 804a/804b |
| Recovery factor based on gas production of 1,000 $m^3$/day | 806a/806b |
| Recovery factor based on gas production of 3,000 $m^3$/day | 808a |
| Recovery factor based on gas production of 10,000 $m^3$/day | 810a/810b |

The plots of FIG. 8 suggest that, relative to the conventional SAGD blowdown methods discussed previously, the methods of the present disclosure correlate with higher oil production rates at a gas production rate of 1,000 $m^3$/day (plot 800*a* vs plot 800*b*). Moreover, the plots of FIG. 8 suggest that the methods of the present disclosure correlate with higher recovery factors, due to higher oil-productions rates, which enable sustained blowdown periods (806*a* vs 806*b*; 810*a* vs 810*b*).

Figure 9:
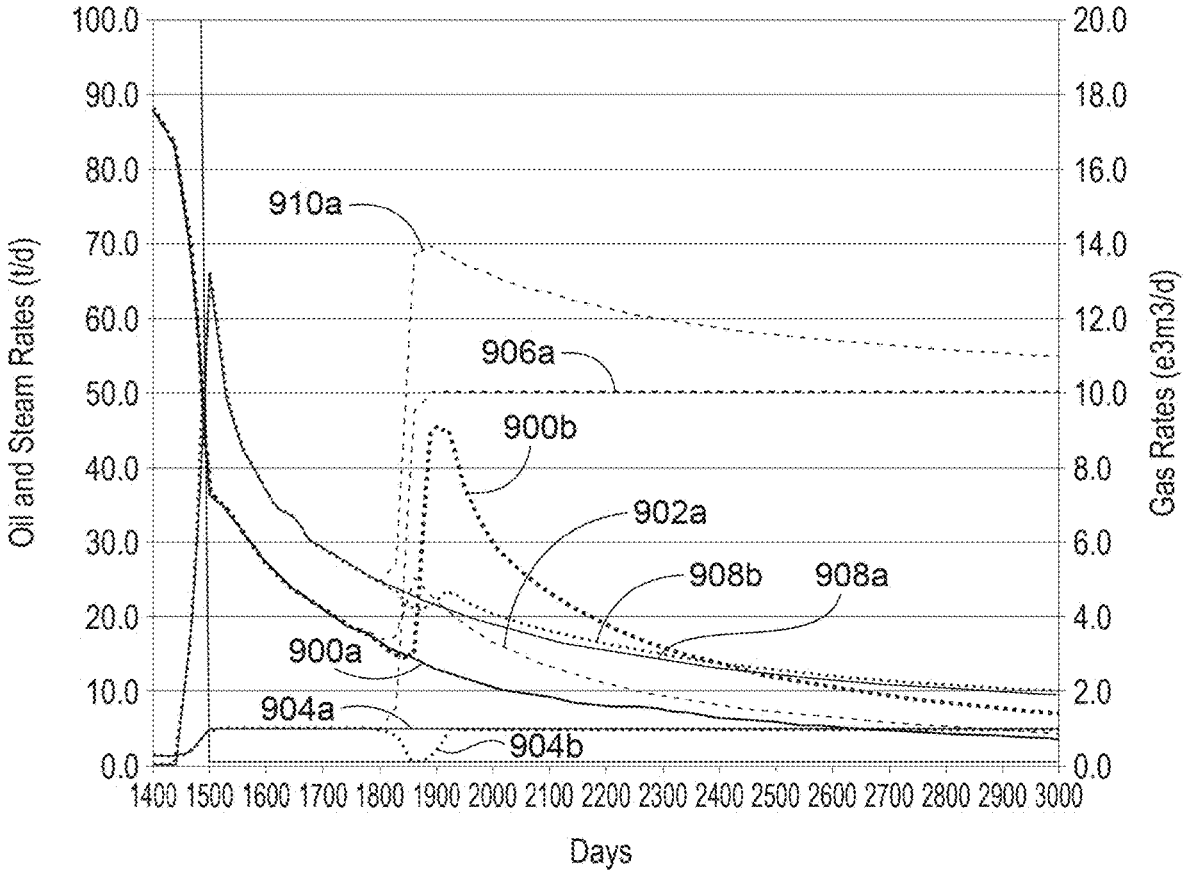
FIG. 9 shows plots of various blowdown parameters as a function of time for methods in accordance with the present disclosure as compared to those used in conventional blowdown methods.

FIG. 9 shows plots of various blowdown parameters as a function of time for methods in accordance with the present disclosure as compared to those used in conventional blowdown methods (as set out above with reference to FIG. 6). The plots in FIG. 9 are indicated by the reference numbers set out in Table 3. Equivalent parameters are indicated with like reference numbers. Those associated with conventional methods include the suffix "a", while those associated with methods in accordance with the present disclosure include the suffix "b".

TABLE 3

Reference numbers for plots of various blowdown parameters as a function of time in FIG. 9 (reference numbers for conventional methods include the suffix "a", while those associated with methods in accordance with the present disclosure include the suffix "b").

| Plot as a function of time | Reference Number(s) |
|---|---|
| Oil production rate based on gas production of 1,000 $m^3$/day | 900a/900b |
| Oil production rate based on gas production of 10,000 $m^3$/day | 902a |
| Gas production rate based on gas production of 1,000 $m^3$/day | 904a/904b |
| Gas production rate based on gas production of 10,000 $m^3$/day | 906a |
| Gas injection rate based on gas production of 1,000 $m^3$/day | 908a/908b |
| Gas injection rate based on gas production of 10,000 $m^3$/day | 910a |

The plots of FIG. 9 suggest that relative to the conventional SAGD blowdown methods discussed previously, the methods of the present disclosure correlate with higher oil rates while requiring lower gas production rates and gas injection rates.

Figure 10A:
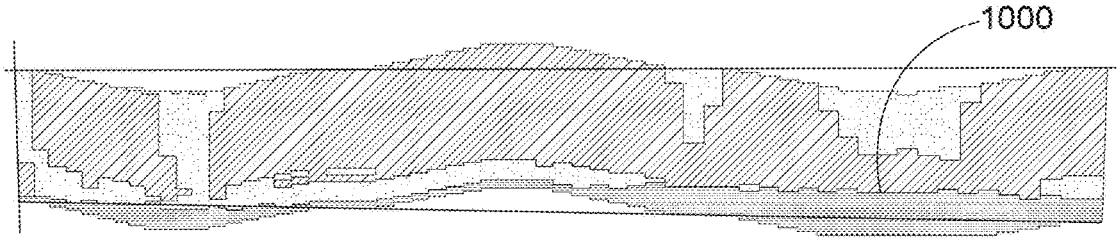
FIG. 10A and FIG. 10B show the pay of FIG. 3 in profile view four years into the blowdown phase of a conventional method.
Figure 10B:
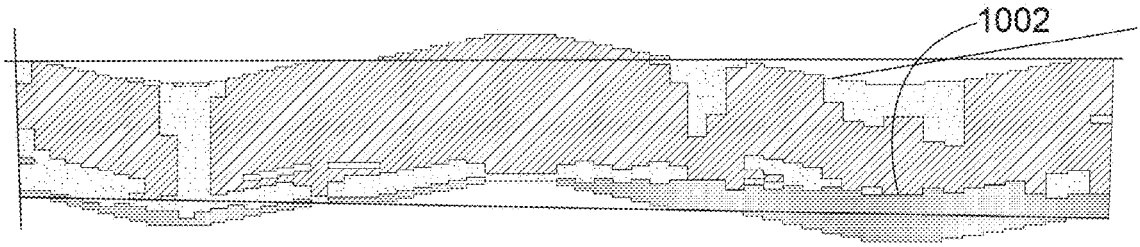
Figure 10C:
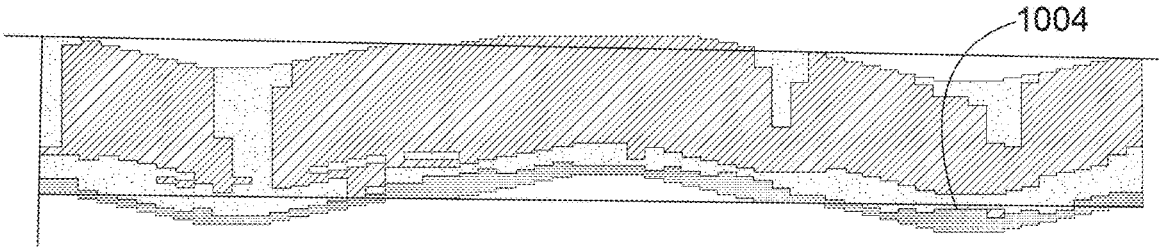
FIG. 10C shows the pay of FIG. 3 in profile view four years into the blowdown phase of a method in accordance with the present disclosure.

FIG. 10A and FIG. 10B show the pay 300 of FIG. 3 in profile view four years into the blowdown phase of a conventional method as described above with reference to FIG. 6. FIG. 10C shows the pay 300 of FIG. 3 in profile view four years into the blowdown phase of a method in accordance with the present disclosure as described above with reference to FIG. and FIG. 9. In FIG. 10A, the blowdown phase comprised four years of gas production at a rate of about 1,000 $m^3$/day. In FIG. 10B, the blowdown phase comprised one year of gas production at a rate of about 1,000 $m^3$/day and three years at a rate of about 10,000 $m^3$/day. In FIG. 10C, the blowdown phase comprised four years of gas production at a rate of about 1,000 $m^3$/day based on a completion as described with reference to FIG. 8 and FIG. 9. In FIG. 10A-C, fluid density is indicated by saturation gradient, where darker shades indicate low-gas concentration fluids (i.e. emulsion rich) and lighter shades indicate high gas-concentration fluids (i.e. emulsion poor). In FIG. 10A-C, the liquid levels vary along the lengths of the wells as indicated by reference numbers 1000, 1002, and 1004, respectively. Comparing the liquid level 1004 (FIG. 10C) to the liquid levels 1000 and 1002 (FIG. 10A-B), suggests that the methods of the present disclosure provide lower liquid levels than those achieved by conventional SAGD blowdown methods.

In the present disclosure, all terms referred to in singular form are meant to encompass plural forms of the same. Likewise, all terms referred to in plural form are meant to encompass singular forms of the same. Unless defined otherwise, all technical and scientific terms used herein have the same meaning as commonly understood by one of ordinary skill in the art to which this disclosure pertains.

As used herein, the term "about" refers to an approximately +/−10% variation from a given value. It is to be understood that such a variation is always included in any given value provided herein, whether or not it is specifically referred to.

It should be understood that the compositions and methods are described in terms of "comprising," "containing," or "including" various components or steps, the compositions and methods can also "consist essentially of or "consist of the various components and steps. Moreover, the indefinite articles "a" or "an," as used in the claims, are defined herein to mean one or more than one of the element that it introduces.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present disclosure is well adapted to attain the ends and advantages mentioned as well as those that are inherent therein. The particular embodiments disclosed above are illustrative only, as the present disclosure may be modified and practiced in different but equivalent manners apparent to those skilled in the art having the benefit of the teachings herein. Although individual embodiments are discussed, the disclosure covers all combinations of all those embodiments. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative embodiments disclosed above may be altered or modified and all such variations are considered within the scope and spirit of the present disclosure. If there is any conflict in the usages of a word or term in this specification and one or more patent(s) or other documents that may be incorporated herein by reference, the definitions that are consistent with this specification should be adopted.

Many obvious variations of the embodiments set out herein will suggest themselves to those skilled in the art in light of the present disclosure. Such obvious variations are within the full intended scope of the appended claims.

The invention claimed is:

1. A method for producing hydrocarbons from a subterranean reservoir that is penetrated by an injection well and a production well, wherein the production well comprises a substantially-horizontal section along which a plurality of individually-actuatable fluid-inlet components are spaced apart to define a plurality of production-well fluid-inlet zones in hydraulic communication with the horizontal section of the production well, the method comprising:

injecting an injection fluid comprising a non-condensable gas into the reservoir, by way of the injection well, to drive steam, solvent, mobilized hydrocarbons, or a combination thereof to occupy one or more of the production-well fluid-inlet zones as a drainage fluid, the drainage fluid comprising a liquid phase portion and a gas phase portion, wherein the gas phase portion of the drainage fluid further comprises at least a portion of the non-condensable gas;

producing a production fluid at a production-flow rate via a pump running at a pump speed and in hydraulic communication with the production fluid, wherein the production fluid comprises at least a portion of the liquid phase portion of the drainage fluid and at least a portion of the gas phase portion of the drainage fluid such that the production fluid is defined by a liquid phase:gas phase ratio reflecting the proportions of the portion of the liquid phase portion in the production fluid and the portion of the gas phase portion in the production fluid;

identifying at least one of the production-well fluid-inlet zones as having a gas content above a threshold and thus being a higher-gas zone; and selectively actuating at least one of the plurality of fluid-inlet components adjacent and corresponding to the higher-gas zone to reduce flow of the drainage fluid through the at least one of the plurality of fluid-inlet components corresponding to the higher-gas zone and thereby increase the liquid phase:gas phase ratio of the production fluid by prioritizing hydraulic communication with at least one other of the plurality of production-well fluid-inflow zones spaced apart from the higher-gas zone, and actuating variations in the pump speed to modulate the production-flow rate and account for the variations in one or more of the plurality of fluid-inlet components.

2. The method of claim 1, wherein the plurality of fluid-inlet components comprises one or more inflow-control devices.

3. The method of claim 2, wherein the one or more inflow-control devices comprise shiftable ports that are configured for remote operation.

4. The method of claim 3, wherein the shiftable ports are actuated in response to changes in distributed acoustic sensing (DAS), distributed temperature sensing (DTS), or a combination thereof.

5. The method of claim 2, wherein the one or more inflow-control devices are autonomous inflow-control devices.

6. The method of claim 1, wherein the plurality of fluid-inlet components comprises one or more upper production ports.

7. The method of claim 6, wherein one or more of the plurality of fluid-inlet components are coupled to a production-string tubing that is in hydraulic communication with the pump.

8. The method of claim 1, wherein the plurality of fluid-inlet components are spaced apart by between about 50 m and about 500 m along the substantially-horizontal section of the production well.

9. The method of claim 1, wherein one or more of the plurality of fluid-inlet components are interposed between annulus-flow restrictors.

10. The method of claim 9, wherein the annulus-flow restrictors comprise packers.

11. The method of claim 1, wherein actuating variations in the pump speed comprises adjusting parameters such that the average gas-production rate is between about 1,000 $m^3$/day and about 30,000 $m^3$/day under STP conditions.

12. The method of claim 1, wherein at least one of the plurality of production-well fluid-inlet zones has a temperature of between about 50° C. and about 300° C.

13. The method of claim 1, wherein at least one of the plurality of production-well fluid-inlet zones has a pressure of between about 500 kPaA and about 10,000 kPaA.

14. The method of claim 1, wherein the NCG is methane, flue gas, $CO_2$, $O_2$, $N_2$, or a combination thereof.

15. The method of claim 1, wherein the subterranean reservoir is a thin pay reservoir having an average height of between about 5 m and about 15 m.

16. The method of claim 1, wherein actuating variations in the pump speed comprises adjusting parameters such that the average gas-production rate is between about 10,000 $m^3$/day and about 30,000 $m^3$/day under STP conditions.

17. The method of claim 1, wherein actuating variations in the pump speed comprises adjusting parameters such that the average gas-production rate is between about 20,000 $m^3$/day and about 30,000 $m^3$/day under STP conditions.

18. The method of claim 1, wherein at least one of the plurality of production-well fluid-inlet zones has a temperature of between about 70° C. and about 250° C.

19. The method of claim 1, wherein at least one of the plurality of production-well fluid-inlet zones has a temperature of between about 120° C. and about 200° C.

20. The method of claim 1, wherein at least one of the plurality of production- well fluid-inlet zones has a pressure of between about 1,000 kPaA and about 8,000 kPaA.

21. The method of claim 1, wherein at least one of the plurality of production- well fluid-inlet zones has a pressure of between about 3,000 kPaA and about 6,000 kPaA.

22. The method of claim 1, wherein the plurality of fluid-inlet components are spaced apart by between about 100 m and about 400 m along the substantially-horizontal section of the production well.

23. The method of claim 1, wherein the plurality of fluid-inlet components are spaced apart by between about 200 m and about 350 m along the substantially-horizontal section of the production well.

* * * * *